US008721415B2

(12) United States Patent
Uhren et al.

(10) Patent No.: US 8,721,415 B2
(45) Date of Patent: May 13, 2014

(54) METHOD FOR OPERATING COMPUTER-BASED SOLITAIRE GAME WITH STACK-BASED PAY TABLE

(71) Applicant: Solitairus Inc., Gananoque (CA)

(72) Inventors: Cameron M. Uhren, Ganaoque (CA); K. C. Flynn, Kitchener (CA); Leonard Parente, Burlington (CA)

(73) Assignee: Solitairus Inc., Gananoque, Ontario (CA)

( * ) Notice: Subject to any disclaimer, the term of this patent is extended or adjusted under 35 U.S.C. 154(b) by 0 days.

(21) Appl. No.: 13/956,987

(22) Filed: Aug. 1, 2013

(65) Prior Publication Data

US 2014/0066152 A1 Mar. 6, 2014

Related U.S. Application Data

(60) Provisional application No. 61/697,724, filed on Sep. 6, 2012.

(51) Int. Cl.
*A63F 9/24* (2006.01)

(52) U.S. Cl.
USPC ..... 463/11; 463/9; 463/10; 463/16; 463/25; 463/43; 273/274; 273/292; 273/293

(58) Field of Classification Search
USPC ..... 463/16–20, 23, 25, 43, 9–11; 273/274, 273/292, 293
See application file for complete search history.

(56) References Cited

U.S. PATENT DOCUMENTS

| | | | | |
|---|---|---|---|---|
| 5,653,635 | A * | 8/1997 | Breeding | 463/11 |
| 6,960,135 | B2 | 11/2005 | Gaidarev et al. | |
| 7,780,518 | B2 | 8/2010 | Yoseloff | |
| 7,980,942 | B2 * | 7/2011 | Kane | 463/18 |
| 7,985,127 | B2 | 7/2011 | Cutter et al. | |
| 8,152,643 | B2 | 4/2012 | Halliburton et al. | |
| 8,328,614 | B2 * | 12/2012 | Jones et al. | 463/11 |
| 2003/0193136 | A1 | 10/2003 | Walker et al. | |

OTHER PUBLICATIONS

Las Vegas Solitaire, Microsoft Windows XP, Aug. 2001.*
Penguin, "Solitaire: A Consumer Comparison," http://www.linuxjournal.com/article/5954, Apr. 1, 2002.
Yan et al, "Solitaire: Man versus machine," In Advances in Neural Information Processing Systems, pp. 1553-1560. 2004.
Dillon et al, "Is Vegas-Style Solitaire Fair?" The Morehead Electronic Journal of Applicable Mathematics, 2001.

(Continued)

*Primary Examiner* — Sunit Pandya

(57) ABSTRACT

A method for operating a computer-based solitaire game which collects a player's fee at the start of the game and pays a player award as a function of a per-card payout award and one or more of the number and/or identities of cards that have been transferred from the card deck on foundation stacks. The per-card payout award is determined as a function of an expected number of transferred cards, which number has been determined as a function of a discrete probability density function calculated from outcomes produced in a multi-game simulation. The number of games in the multi-game simulation is selected to provide a statistically stable result, and may be on the order of more than one million games. The simulated games are played by applying a set of ordinally-ranked solitaire game play rules.

23 Claims, 14 Drawing Sheets

(56) References Cited

OTHER PUBLICATIONS

"Solitaire," http://en.wikipedia.org/wiki/Solitaire, last modified on Jun. 21, 2013.

"Klondike (solitaire)," http://en.wikipedia.org/wiki/Klondike_(solitaire), last modified on May 30, 2013.

"Glossary of solitaire terms," http://en.wikipedia.org/wiki/Glossary_of_solitaire_terms, last modified on Sep. 26, 2013.

Harridan et al., "PAR Sheets, probabilities, and slot machine play: Implications for problem and non-problem gambling," Journal of Gambling Issues: Issue 23, pp. 81-110.

"Canfield," http://en.wikipedia.org/wiki/Canfield_(solitaire), last modified on May 30, 2013.

The International Search Report and Written Opinion, mailed on Mar. 19, 2014, in the corresponding PCT Application No. PCT/IB2013/002655.

* cited by examiner

| 91 | 92 | 93 | 94 | 97 | 95 | 96 |
|---|---|---|---|---|---|---|
| # Cards in Foundation Stacks | % of Time Attained | $ per Card | Cost to Play | $ Win | House Advantage | Weighted House Advantage |
| 0 | 0.51% | 4.75 | 50 | 0 | 1 | 0 |
| 1 | 1.86% | 4.75 | 50 | 4.75 | 0.905 | 0.088293 |
| 2 | 4.46% | 4.75 | 50 | 9.5 | 0.81 | 0.42393085 |
| 3 | 7.18% | 4.75 | 50 | 14.25 | 0.715 | 1.023006075 |
| 4 | 9.39% | 4.75 | 50 | 19 | 0.62 | 1.783682 |
| 5 | 10.23% | 4.75 | 50 | 23.75 | 0.525 | 2.42947775 |
| 6 | 9.94% | 4.75 | 50 | 28.5 | 0.43 | 2.83374075 |
| 7 | 9.10% | 4.75 | 50 | 33.25 | 0.335 | 3.0255638 |
| 8 | 7.87% | 4.75 | 50 | 38 | 0.24 | 2.9888482 |
| 9 | 6.57% | 4.75 | 50 | 42.75 | 0.145 | 2.8087776 |
| 10 | 5.37% | 4.75 | 50 | 47.5 | 0.05 | 2.54914925 |
| 11 | 4.40% | 4.75 | 50 | 52.25 | -0.045 | 2.298555875 |
| 12 | 3.55% | 4.75 | 50 | 57 | -0.14 | 2.0226678 |
| 13 | 2.86% | 4.75 | 50 | 61.75 | -0.235 | 1.768909025 |
| 14 | 2.28% | 4.75 | 50 | 66.5 | -0.33 | 1.51890655 |
| 15 | 1.85% | 4.75 | 50 | 71.25 | -0.425 | 1.315567125 |
| 16 | 1.49% | 4.75 | 50 | 76 | -0.52 | 1.1354476 |
| 17 | 1.22% | 4.75 | 50 | 80.75 | -0.615 | 0.9831151 |
| 18 | 0.98% | 4.75 | 50 | 85.5 | -0.71 | 0.83973825 |
| 19 | 0.80% | 4.75 | 50 | 90.25 | -0.805 | 0.72212635 |
| 20 | 0.65% | 4.75 | 50 | 95 | -0.9 | 0.61864 |
| 21 | 0.54% | 4.75 | 50 | 99.75 | -0.995 | 0.538659975 |
| 22 | 0.44% | 4.75 | 50 | 104.5 | -1.09 | 0.45703075 |
| 23 | 0.36% | 4.75 | 50 | 109.25 | -1.185 | 0.3918142 |
| 24 | 0.29% | 4.75 | 50 | 114 | -1.28 | 0.3311928 |
| 25 | 0.24% | 4.75 | 50 | 118.75 | -1.375 | 0.287375 |
| 26 | 0.20% | 4.75 | 50 | 123.5 | -1.47 | 0.242307 |
| 27 | 0.16% | 4.75 | 50 | 128.25 | -1.565 | 0.2055591 |
| 28 | 0.13% | 4.75 | 50 | 133 | -1.66 | 0.1684844 |
| 29 | 0.11% | 4.75 | 50 | 137.75 | -1.755 | 0.149197025 |
| 30 | 0.09% | 4.75 | 50 | 142.5 | -1.85 | 0.12179475 |
| 31 | 0.07% | 4.75 | 50 | 147.25 | -1.945 | 0.099526275 |
| 32 | 0.06% | 4.75 | 50 | 152 | -2.04 | 0.0836 |
| 33 | 0.05% | 4.75 | 50 | 156.75 | -2.135 | 0.0728574 |
| 34 | 0.03% | 4.75 | 50 | 161.5 | -2.23 | 0.0547808 |
| 35 | 0.03% | 4.75 | 50 | 166.25 | -2.325 | 0.042676375 |
| 36 | 0.02% | 4.75 | 50 | 171 | -2.42 | 0.0347301 |
| 37 | 0.02% | 4.75 | 50 | 175.75 | -2.515 | 0.029526 |
| 38 | 0.01% | 4.75 | 50 | 180.5 | -2.61 | 0.01933155 |
| 39 | 0.01% | 4.75 | 50 | 185.25 | -2.705 | 0.014319825 |
| 40 | 0.01% | 4.75 | 50 | 190 | -2.8 | 0.011552 |
| 41 | 0.00% | 4.75 | 50 | 194.75 | -2.895 | 0.007692625 |
| 42 | 0.00% | 4.75 | 50 | 199.5 | -2.99 | 0.00584535 |
| 43 | 0.00% | 4.75 | 50 | 204.25 | -3.085 | 0.001940375 |
| 44 | 0.00% | 4.75 | 50 | 209 | -3.18 | 0.0009196 |
| 45 | 0.00% | 4.75 | 50 | 213.75 | -3.275 | 0.00055575 |
| 46 | 0.00% | 4.75 | 50 | 218.5 | -3.37 | 0.0004807 |
| 47 | 0.00% | 4.75 | 50 | 223.25 | -3.465 | 0.000245575 |
| 48 | 0.00% | 4.75 | 50 | 228 | -3.56 | 0.0001596 |
| 49 | 0.00% | 4.75 | 50 | 232.75 | -3.655 | 0.000116375 |
| 50 | 0.00% | 4.75 | 50 | 237.5 | -3.75 | 0 |
| 51 | 0.00% | 4.75 | 50 | 242.25 | -3.845 | 0 |
| 52 | 4.60% | 4.75 | 50 | 247 | | 11.3554051 |

FIG.9

1201 1202 1203 1206

| | One Time, One Card/Base Game | | | Bonus Payouts Percentage | | | |
|---|---|---|---|---|---|---|---|
| | Cost to Play | Payout/Card | HA/PAR | 1.50 | 2.00 | 2.50 | 3.00 |
| 1 | 150.00 | 14.00 | 94.09 | | | 96.59 | |
| 2 | 100.00 | 9.50 | 95.77 | | | | |
| 3 | 90.00 | 8.50 | 95.21 | | | | |
| 4 | 75.00 | 7.00 | 94.09 | | | | 96.59 |
| 5 | 60.00 | 5.50 | 92.41 | | | | 95.41 |
| 6 | 50.00 | 4.75 | 95.77 | | | | |
| 7 | 43.00 | 4.00 | 93.78 | | | | |
| 8 | 35.00 | 3.25 | 93.61 | | | | 96.61 |
| 9 | 30.00 | 2.75 | 92.41 | | | | 95.41 |
| 10 | 27.00 | 2.50 | 93.74 | | | | |
| 11 | 21.50 | 2.00 | 93.78 | | | | |
| 12 | 16.00 | 1.50 | 94.51 | | 96.41 | | |
| 13 | 13.00 | 1.25 | 91.64 | | | | |
| 14 | 10.75 | 1.00 | 93.78 | | | | |
| 15 | 8.25 | 0.75 | 91.65 | | 96.51 | | |
| 16 | 7.75 | 0.75 | 97.56 | | | | |
| 17 | 5.50 | 0.50 | 91.64 | | | | |
| 18 | 5.00 | 0.45 | 90.73 | | | | |
| 18 | 2.75 | 0.25 | 91.64 | | | | |
| 19 | 1.65 | 0.15 | 91.64 | | | | |
| 20 | 1.10 | 0.10 | 91.64 | | | | |

1204 1205

FIG.12

1301 1302 1303

| Three Times, Third Card Base Game | Cost to Play | Payout/Card | HA/PAR |
|---|---|---|---|
| 1 | 150.00 | 14.00 | 96.10 |
| 2 | 101.00 | 9.50 | 96.85 |
| 3 | 90.50 | 8.50 | 96.71 |
| 4 | 75.00 | 7.00 | 96.10 |
| 5 | 60.00 | 5.00 | 94.39 |
| 6 | 50.50 | 4.75 | 96.85 |
| 7 | 42.50 | 4.00 | 96.91 |
| 8 | 35.00 | 3.25 | 95.61 |
| 9 | 30.00 | 2.75 | 94.37 |
| 10 | 27.00 | 2.50 | 95.34 |
| 11 | 21.50 | 2.00 | 95.79 |
| 12 | 16.50 | 1.50 | 93.61 |
| 13 | 13.75 | 1.25 | 93.61 |
| 14 | 11.00 | 1.00 | 93.61 |
| 15 | 8.25 | 0.75 | 93.61 |
| 16 | 8.00 | 0.75 | 96.53 |
| 17 | 5.50 | 0.50 | 93.61 |
| 18 | 2.75 | 0.25 | 93.61 |
| 19 | 1.65 | 0.15 | 93.61 |
| 20 | 1.10 | 0.10 | 93.61 |

1304

1306 1307

| Bonus Options | Cost to Play | Payout/Card | Bonus% | Total% |
|---|---|---|---|---|
| 20 | 1.65 | 0.15 | 3.00% | 96.61% |
| 21 | 2.75 | 0.25 | 2.00% | 95.61% |
| 22 | 5.50 | 0.50 | 2.00% | 95.61% |
| 23 | 8.25 | 0.75 | 2.00% | 95.61% |
| 24 | 18.50 | 1.50 | 1.75% | 95.07% |
| 25 | 35.00 | 2.75 | 3.00% | 95.13% |
| 26 | 64.00 | 5.50 | 3.00% | 96.09% |
| 27 | 80.00 | 6.75 | 3.00% | 94.40% |
| 28 | 150.00 | 13.00 | 2.50% | 96.38% |

1305

FIG.13

METHOD FOR OPERATING COMPUTER-BASED SOLITAIRE GAME WITH STACK-BASED PAY TABLE

CROSS REFERENCE TO RELATED APPLICATION

This application claims the benefit of priority under 35 §119(e) to U.S. Provisional Patent Application No. 61/697,724, filed Sep. 6, 2012 and entitled "Method for Operating Computer-Based Solitaire Game With Stack-Based Pay Table," which is hereby incorporated by reference in its entirety herein.

BACKGROUND

The game of solitaire has provided entertainment and relaxation for multitudes of individuals when played either manually as a game with a deck of cards or as a video game. The video game of solitaire is typically played by manipulating images of cards displayed for example on a personal computer, a tablet computer, a personal digital assistant or a smartphone.

The popularity of each of the card game and the video game is arguably supported by the one-on-one interaction that individuals have with either the cards directly or with an image of the cards on a video screen of the personal computer. People do not usually compete with other people in solitaire, but work individually with a particular hand of cards to achieve a desired result. Typically, the most sought after result is to turn over all of the cards and arrange the cards in order of color and rank. To accomplish this task is to win the game. Alternatively, for example in another type of solitaire game, the winner must turn up and remove all cards from a tableau. Removal of cards is based upon rules specific for each solitaire game.

Solitaire generally requires both luck and skill. To win a game of one type of solitaire (Klondike solitaire), a player must turn over all cards of a deck and must order the cards according to rank and color in order to then move the cards to rank-ordered "foundation" piles or stacks provided for each suit. The game is won when all cards have been moved to the foundation stacks.

For a conventional video solitaire game, a computer randomly orders the cards according to a conventional random card shuffling algorithm. This type of video solitaire game typically does not include an adjustment for a player's level of skill in playing the game of solitaire. For the manual card game of solitaire, the shuffling of each hand of cards randomizes the order of the cards in the deck.

A manual solitaire game developed by Richard Canfield in the early $20^{th}$ century included steps of buying a deck of cards for fifty dollars and playing a game of Canfield solitaire. The player received five dollars for each card placed on the foundation stacks at the end of the game. The game is more particularly described in Hoyle's Rules and Games, edited by Albert Moorehead and Geoffrey Mott-Smith, published in 1946. Canfield's game does not appear at present be played in its originally-played form on a modern casino floor, perhaps because of the difficulty and costs associated with administering the game in this form.

With the advent of electronic and networked gaming systems (including Internet gaming systems), it would be more efficient to administer the game of solitaire in an electronic form. However, the complexities of play (including the number of possible outcomes from player moves during a game as contrasted to "single-outcome games" such as video slot machines), have heretofore made it difficult to adequately model such a game in order to set buy-in and pay-out prices, and to demonstrate to casino regulators with particularity that casino operators' advantage in the game and likely hold percentages of the pay-in amounts will fall within acceptable limits.

SUMMARY

Aspects of the present disclosure are directed to methods for operating a computer-based solitaire game. According to an aspect of the present disclosure, a computer-based method of operating a solitaire game is provided which collects a player's fee at the start of the game and pays a player award that is accumulated as cards are moved to the foundation stacks. The per-card payout award is determined as a function of an expected number of transferred cards, which number has been determined as a function of a discrete probability density function calculated from outcomes produced in a multi-game simulation of the solitaire game. The number of games in the multi-game simulation is selected to provide a statistically stable result, in particular to demonstrate to casino regulators with particularity that a game operators' advantage in the game and likely hold percentages of the pay-in amounts will fall within acceptable regulatory limits.

Advantageously and according to another aspect of the present disclosure, the number of simulated games may be on the order of more than one million games.

According to another aspect of the present disclosure, the simulated games may be played by applying an optimum set of ordinally-ranked solitaire game play rules.

According to another aspect of the present disclosure, the per-card payout award may vary as a function of the number of cards transferred during the game.

According to another aspect of the present disclosure, the per-card payout award may vary according to identities of the transferred cards.

According to another aspect of the present disclosure, the per-card payout award may vary according to a distribution of the transferred cards among the foundation stacks.

Another aspect of the present disclosure is also directed to a computer-based method for determining the expected number of transferred cards by means of the multi-game simulation. Each simulated game is played by generating an electronic representation of a randomly-ordered card deck and simulating game play by executing an available card plays according to applicable optimum game play rules selected from a plurality of predetermined ordinally-ranked solitaire game play rules. For each play, an applicable game play rule having a highest ordinal ranking among applicable rules is identified and applied to execute the play. Upon completion of the play, the electronic representation of the play is updated and play continues until the detection of an end of game indication. At game completion, the number of cards transferred to foundation stacks is determined, and information indicative of the number of cards transferred is stored in a memory of the computer. In addition, a statistical indicator (for example, a standard deviation) associated with a discrete probability density function for the number of transferred cards is calculated. Game play continues so long as the statistical indicator fails to meet a predetermined threshold. When game play is ended, an expected value for the number of transferred cards is calculated as a function of the discrete probability density function.

Advantageously and according to another aspect of the present disclosure, estimates of a game operators' house advantage may be calculated in the multi-game simulation as a function of the discrete probability density function, a selected per-card payout award and a selected player's fee.

BRIEF DESCRIPTION OF THE DRAWING

A more complete understanding of the present disclosure may be realized by reference to the accompanying drawing in which:

FIG. 9 is a table depicting an exemplary outcome for a simulated game the play of a computer-based solitaire game according to an aspect of the present disclosure;

FIG. 12 is a first table illustrating payout information based on simulated game play results according to an aspect of the present disclosure; and FIG. 13 is a second table illustrating payout information based on simulated game play results according to an aspect of the present disclosure.

Figure 1A:
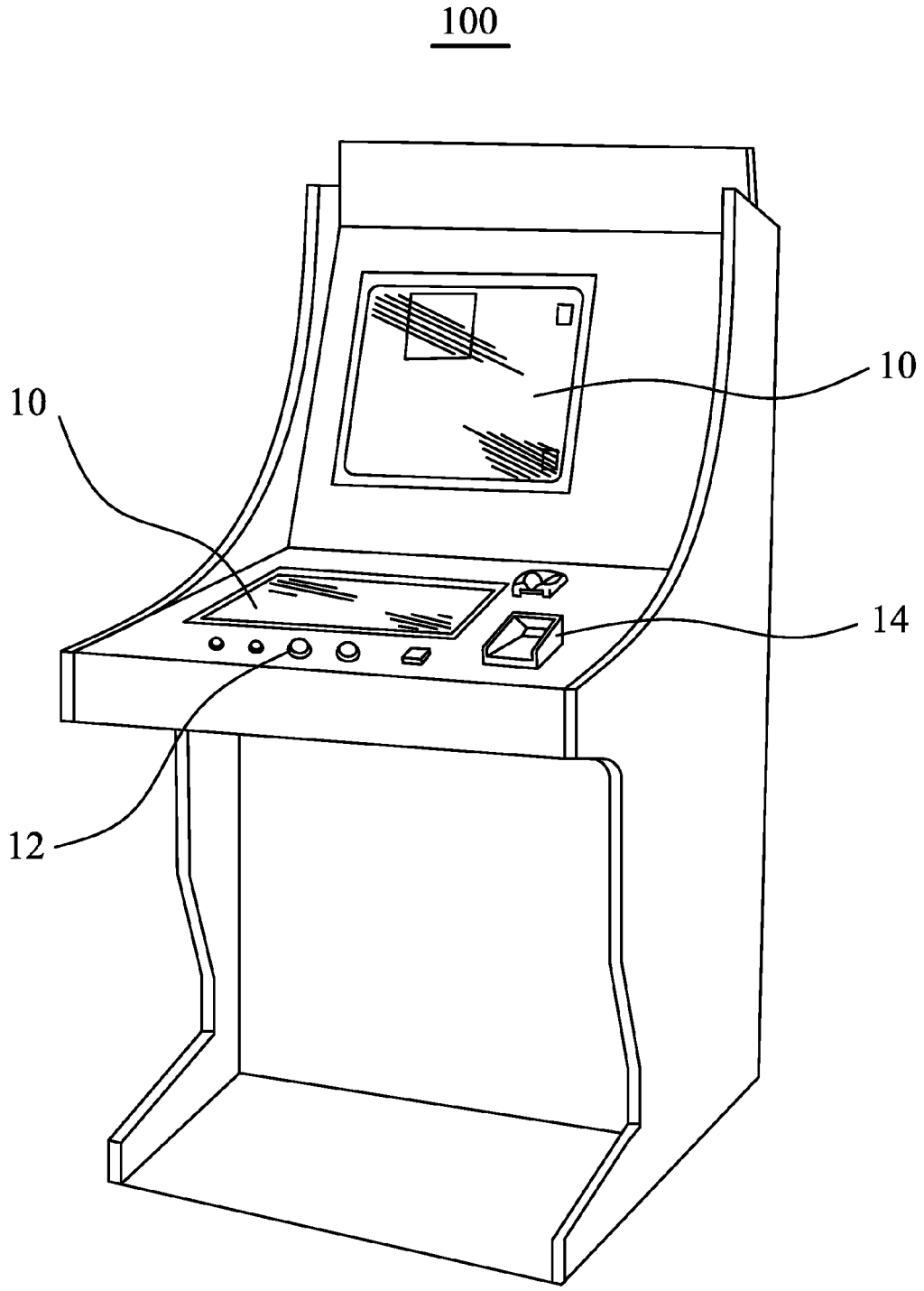
FIG. 1A is a perspective drawing depicting an exemplary gaming device according to an aspect of the present disclosure.

The illustrative embodiments are described more fully by the Figures and detailed description. The inventions may, however, be embodied in various forms and are not limited to specific embodiments described in the Figures and detailed description.

DESCRIPTION

The following illustrates the principles of the disclosure. It will thus be appreciated that those skilled in the art will be able to devise various arrangements which, although not explicitly described or shown herein, embody the principles of the disclosure and are included within its spirit and scope.

All examples and conditional language recited herein are principally intended expressly to be only for pedagogical purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that any flow charts, flow diagrams, and the like represent various processes which may be substantially represented in computer readable medium and so executed by a computer or processor, whether or not such computer or processor is explicitly shown.

The functions of the various elements shown in the Figures, including any functional blocks labeled as "processors" or "central processing units," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

Unless otherwise explicitly specified herein, the drawings are not drawn to scale.

We now provide some non-limiting, illustrative examples that illustrate several operational aspects of various arrangements and alternative embodiments of the present disclosure. Aspects this disclosure are directed to a computer-based method of operating a solitaire game which collects a player's fee at the start of the game and pays a player award as a function of a per-card payout award and one or more of the number and/or identities of cards that have been transferred from the card deck on foundation stacks. The per-card payout award is determined as a function of an expected number of transferred cards, which number has been determined as a function of a discrete probability density function calculated from outcomes produced in a multi-game simulation. The number of games in the multi-game simulation is selected to provide a statistically stable result, and may be on the order of more than one million games. The simulated games are played by applying a set of optimum ordinally-ranked solitaire game play rules.

The number of games in the multi-game simulation is selected to provide a statistically stable result, in particular to demonstrate to casino regulators with particularity that a game operators' advantage in the game and likely hold percentages of the pay-in amounts will fall within acceptable regulatory limits. Estimates of the resultant game operators' house advantage and long-term hold percentages of players' fees may be provided in order to ensure that these fall within acceptable limits as may be required, for example, by associated regulatory groups and commissions.

The a computer-based solitaire game, for example may be implemented in a dedicated gaming device or on-line in an Internet-based service. FIG. 1A provides a perspective drawing depicting a conventional, dedicated gaming device as may be found, for example, on a casino floor. One of skill in the art will readily recognize that FIG. 1A depicts only one of many different dedicated gaming devices which may be used in conjunction with aspects of the present disclosure. Other classes of conventional, dedicated gaming devices which may be so used include video slot machines and video lottery terminals (VLTs). For games implemented using Internet-based services, gaming devices may include personal computers or other personal computing devices (for example, including mobile devices such as personal digital assistants and smartphones as described herein infra with reference to FIG. 3).

Gaming devices that are used in conjunction with aspects of the present disclosure may typically have elements depicted by the gaming device 100 of FIG. 1A, for example including:

1) one or more display screens 10 which facilitate interactive gaming for the solitaire game platform;

2) input devices 12 and/or other associated operating methods for:

i) moving and/or positioning game cards on the game screen by a player, ii) selecting associated actions (for example, selecting the action of playing a solitaire game), and/or iii) for accepting physical or electronic funds, paper money, coins, tokens, electronic gaming vouchers, electronic gaming credits and the like, and/or iv) for identifying and tracking the play of individual players;

3) input devices 14 and/or other associated operating methods for providing payments, for example, via an electronic distribution of gaming vouchers, dispensing of physically-stored cash or tokens, deposits into player accounts, and the like;

4) operating software located on one or more of the gaming device and/or an associated server;

5) associated software and/or hardware (for example, including electronic or mechanical accounting meters) for tracking a number of games played, an amount of funds collected, an amount of funds paid, and the like; and 6) one or more network or other input/output interfaces for interacting with other gaming systems that may provide, for example, various management, accounting and oversight functions.

The other associated operating methods identified with input devices 12, 14 may, for example, include operating software for operating touch screen features of the one or more display screens 10.

Figure 2:
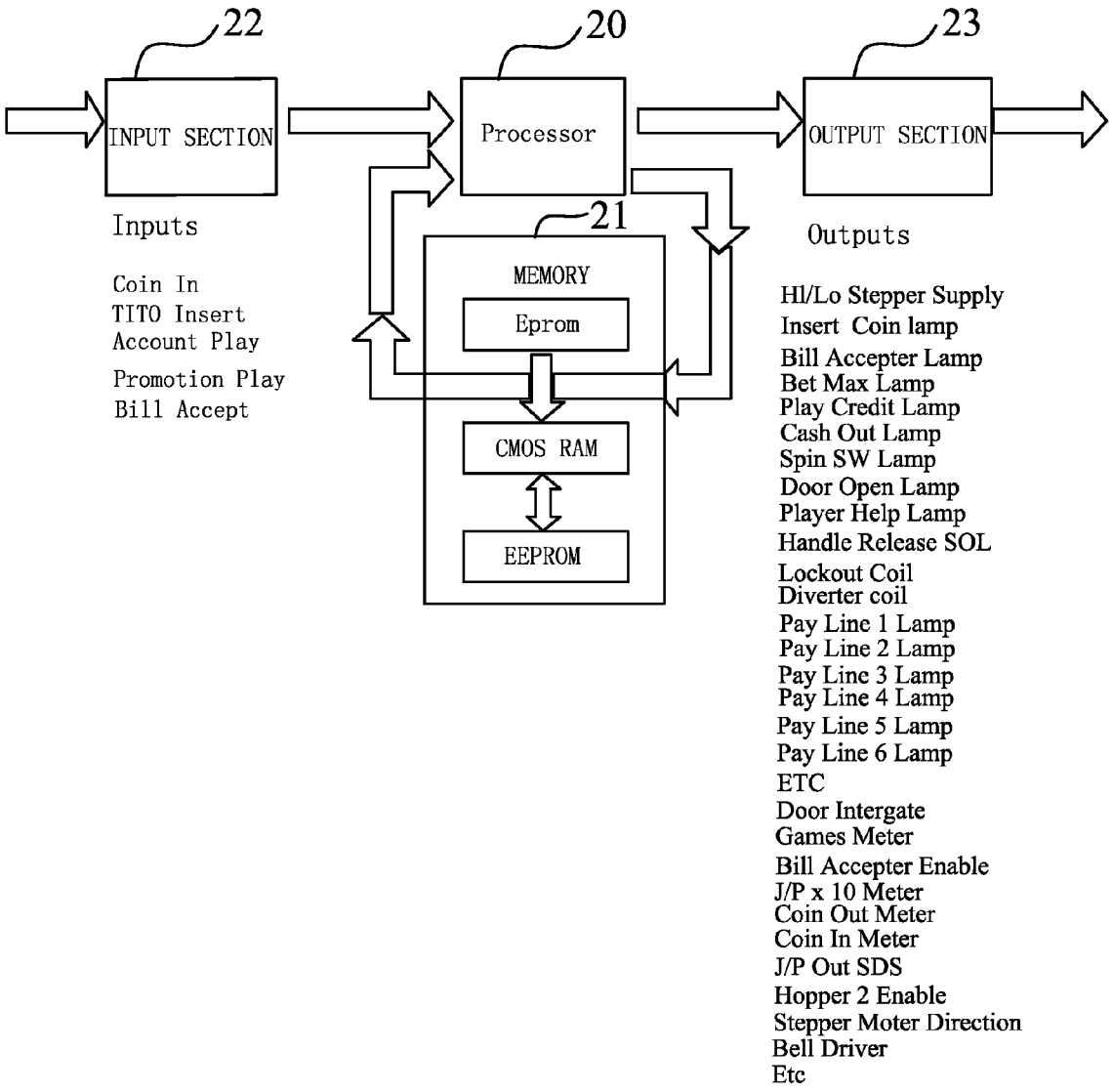
FIG. 2 is a schematic drawing further depicting the gaming device of FIG. 1A.

FIG. 2 provides a schematic drawing that further illustrates the elements of the gaming device 100 of FIG. 1A. As shown, the gaming device may include a processor 20 coupled to a memory 21 (for example, including one or both of volatile and non-volatile memory elements) for storing operational software of the device and associated game play and other data. An input section 22 may for example include various input devices and/or associated operating software components for accepting funds and player instructions. An output section 23 may for example include a game display and/or various other output devices (for example, including indicator lamps, electromechanical actuators and relays, meters, audio devices and bells, and the like).

Figure 1B:
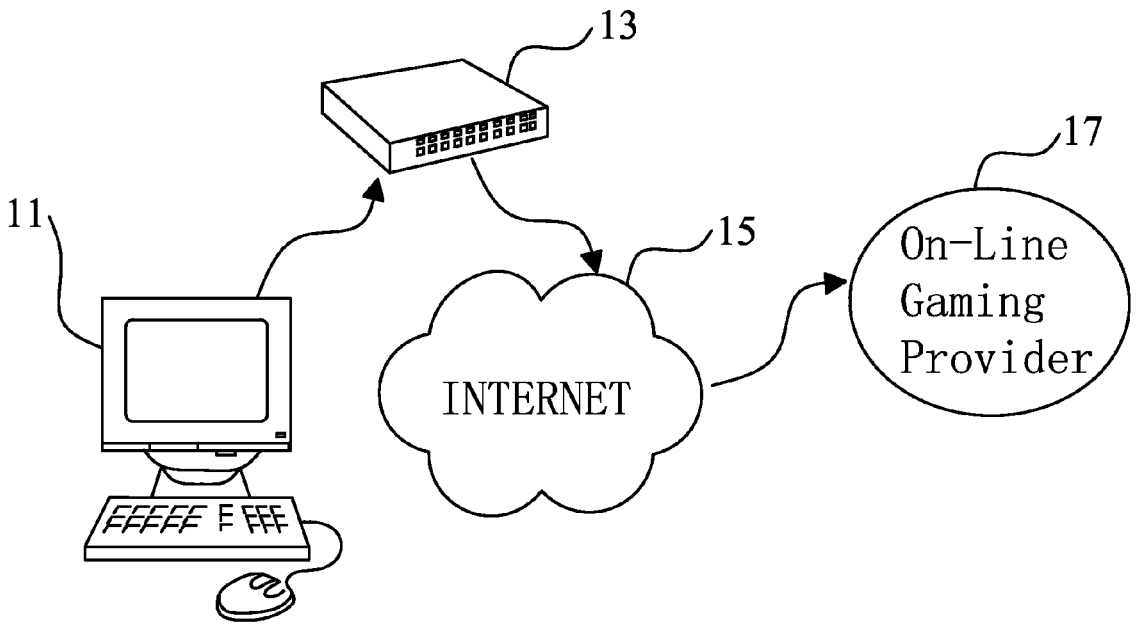
FIG. 1B is a schematic drawing depicting an exemplary internet-based gaming system according to an aspect of the present disclosure.

FIG. 1B provides a schematic drawing depicting an internet-based gaming system 120 according to an aspect of the present disclosure. Player input and display features may be provided by a personal computer 11 or other personal computing device, which may be interconnected via a network interface to a local networking device 13 that may be coupled to a wide-area network (WAN) 15 such as the Internet. One or more servers 17 of an on-line gaming provided may also be also coupled to WAN 15, and may serve to completely execute the operating software of the game. Alternatively, for example, a portion of the operating software of the game may be downloadably installed for operation on the personal computer 11 or other personal computing device (for example, including mobile devices such as personal digital assistants and smartphones as described herein infra with reference to FIG. 3), and a remaining portion of the operating software may be installed on and executed by the one or more servers.

Figure 3:
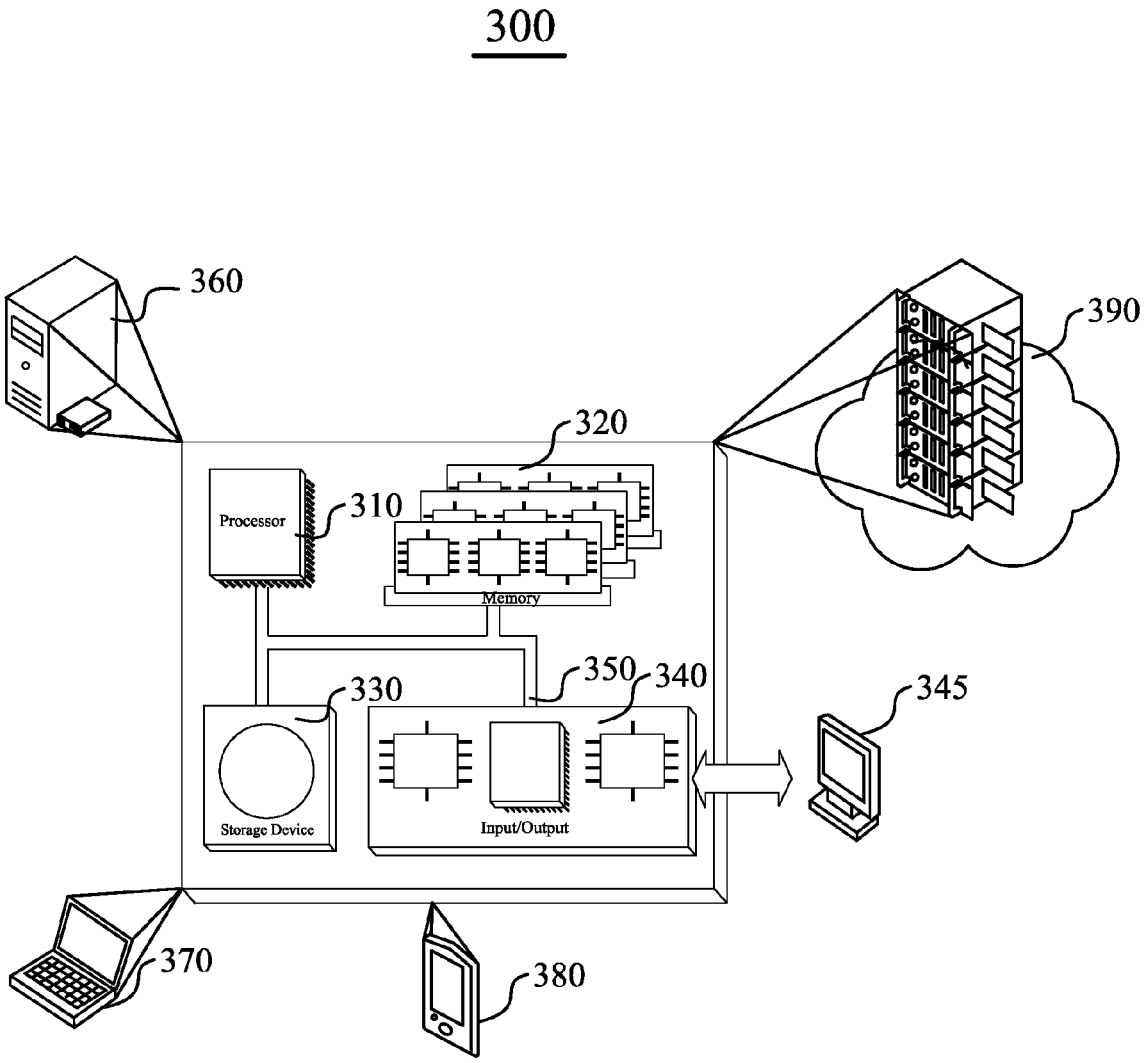
FIG. 3 is a schematic drawing further depicting an exemplary computer system for use in the internet-based gaming system of FIG. 1B.

FIG. 3 provides a schematic drawing further depicting an exemplary computer system 300 as may be used, for example, to provide the one or more servers 17 illustrated by FIG. 1B. The computer system 300 may comprise, for example a computer running any of a number of operating systems. The above-described methods of the present disclosure may be implemented on the computer system 300 as stored program control instructions.

As depicted in FIG. 3, computer system 300 includes processor 310, memory 320, storage device 330, and input/output structure 340. One or more input/output devices may include a display 345. One or more busses 350 typically interconnect the components 310, 320, 330, and 340. Processor 310 may for example be either of a single or multi core processor.

Processor 310 may execute instructions related to aspects of the present disclosure as can be described by flow diagrams presented in one or more of the Figures. Such instructions may be stored in memory 320 or storage device 330. Data and/or information may be received and output using one or more input/output devices.

Memory 320 may store data and may be a computer-readable medium, such as volatile or non-volatile memory. Storage device 330 may provide storage for system 300, for example, to store instructions related to aspects of the present disclosure. In various aspects, storage device 330 may be a flash memory device, a disk drive, an optical disk device, or a tape device employing magnetic, optical, or other recording technologies.

Input/output structures 340 may provide input/output operations for system 300. Input/output devices utilizing these structures may include, for example, keyboards, displays 345, pointing devices, and microphones—among others. As shown and may be readily appreciated by those skilled in the art, computer system 300 for use with the present disclosure may be implemented in a desktop computer package 360, a laptop computer 370, a hand-held computer, for example a tablet computer, personal digital assistant or smartphone 380, or one or more server computers which may advantageously comprise a "cloud" computer 390.

Figure 4:
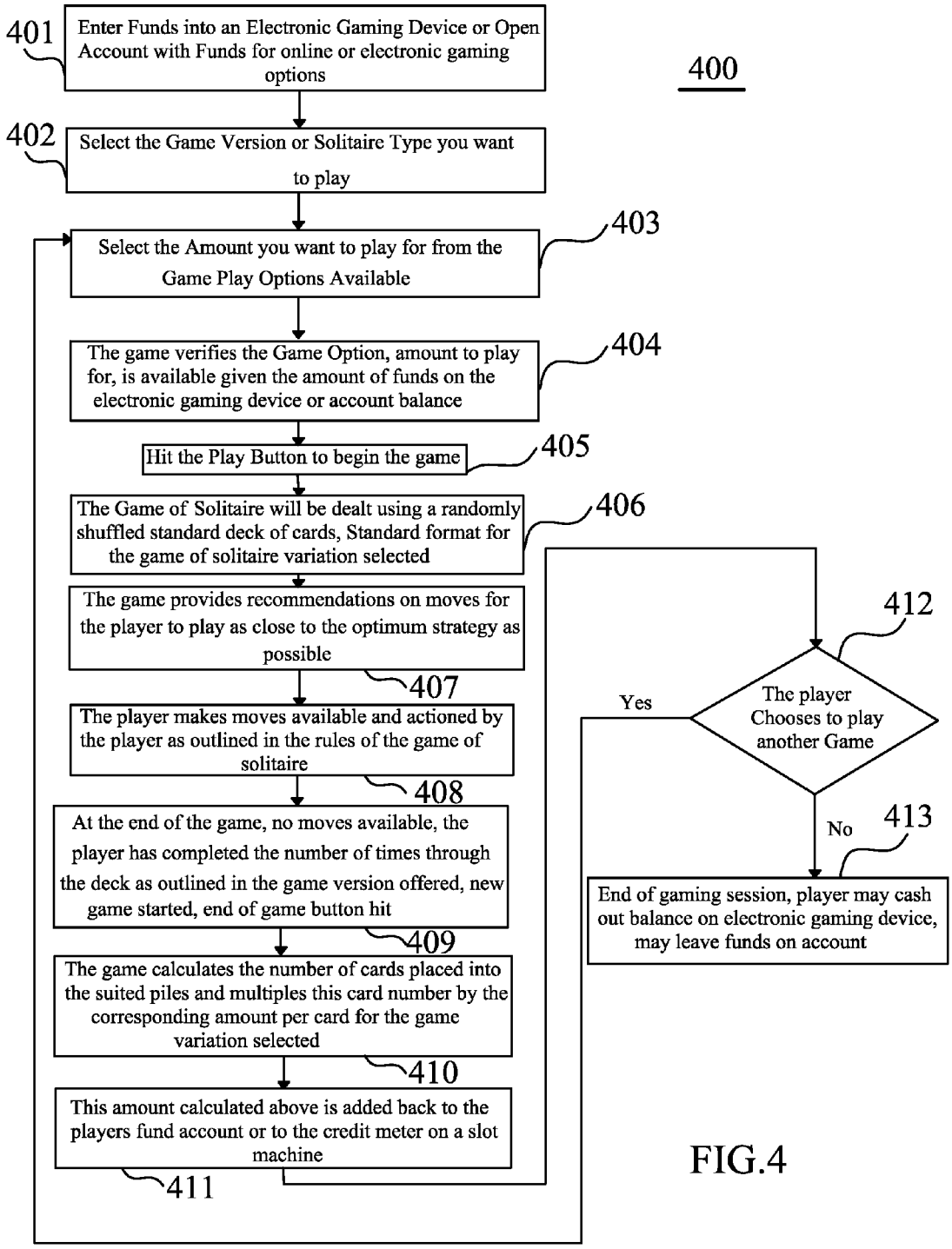
FIG. 4 is a flow diagram depicting an exemplary operational overview for playing a computer-based solitaire game according to an aspect of the present disclosure.

FIG. 4 is a flow diagram providing an exemplary operational overview 400 for playing a computer-based solitaire game according to an aspect of the present disclosure. At step 401, a player proceeds to enter funds for playing a solitaire game, or alternatively opens and/or accesses a player account from which electronic funds may be withdrawn for playing the game. At step 402, the player selects a particular solitaire game type (for example, a three-card draw game or a one-card draw game), and at step 403 selects a play amount (for example, one game, two games, and so on). At step 404, the game then verifies the inputs provided by the player, and activates an indicator (for example, on a display screen or associated indicator lamp) instructing the player that a game is ready to be played. The player then operates an input device (for example, a game play button) at step 405 to begin that game.

At step 406, the computer-based solitaire game proceeds to prepare an electronic representation of a randomly-ordered ("shuffled") card deck, and a display format for representing the game play field on a display device. Optionally, at shown at step 407, the computer-based game may proceed to identify a recommended move to the player (for example, by a applying a rule set including a series of ordinally-ranked game play rules).

The player is then able at step 408 to provide inputs for making game moves in accordance with the current state of the game as displayed in the game play field on the display screen. The player's desired moves are evaluated by the computer-implemented game (for example, by applying the series of optimum ordinally-ranked game play rules). If feasible according to the optimum ordinally-ranked game play rules, the moves are then processed in order to prepare and display an updated game play field on the display screen.

At step 409, when the computer-implemented game determines that no additional feasible moves are available to the player and/or that a game ending event has occurred (for example, completing a predetermined number of draws through the card deck), the game play field provides the player with a choice to begin a new game or to end the session. To assist the player in making this decision, the computer-implemented game may next at step 410, for example, calculate the number of cards placed onto the foundation stacks, and multiply this number by a single per-card payout award to determine a payout for the game. Alternatively the present disclosure also contemplates per card player award amounts that may, for example, vary according to the number of foundation stack cards, the identities of the foundation stack cards and/or a distribution of the transferred cards among the foundation stacks.

At steps 410 and 411, the payout amount may be accumulated with payouts recorded, for example, with payouts for prior games played in a current game session either in a via the WAN 15 player's fund account and/or locally to a credit meter on the game device. At step 412, the player decides whether or not to proceed to play another game, or to conclude the game play session. If the player decides to continue, the computer-implemented game returns to step 403 for the player to select a game play amount. Otherwise, the game play session concludes at step 413, so that the computer-implemented game may enable the player to cash out an award balance or accumulate the award balance as funds on account.

Figure 5:
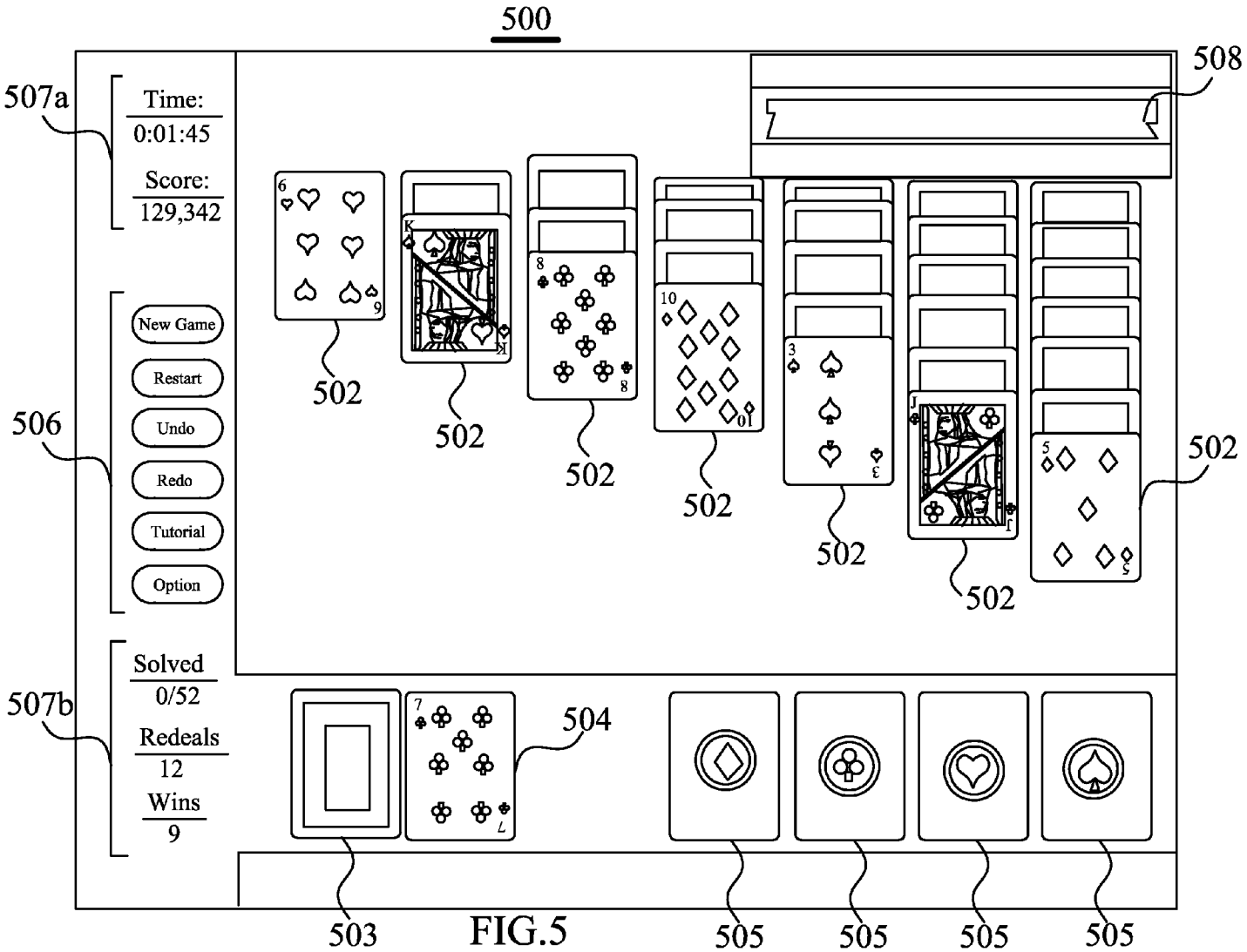
FIG. 5 is a schematic diagram depicting an exemplary display screen for a computer-based solitaire game according to an aspect of the present disclosure.

FIG. 5 depicts an exemplary display screen 500 displaying a game play field for a computer-based solitaire game according to an aspect of the present disclosure. As depicted, the display screen depicts seven card piles 501 each having an uppermost card 502 in a face-up position, a card deck 503 showing an uppermost card in a face down position, a currently selected card 504 from the card deck in a face-up position and four foundation stacks 505. Each of the four foundation stacks is typically associated with one suit in the card deck. In the exemplary display depicted by FIG. 5, no cards have yet been advanced to the foundation stacks.

As further depicted by FIG. 5, the display 500 may preferably display "soft" function buttons 506 that can be selected by a player (for example, by use of a pointing device, a stylus or a touch screen) to initiate various play actions of the game (for example, including a game start, a game restart, a move undo, a move redo) and/or various auxiliary actions (for example, selecting various game options including the display of a game tutorial). The display 500 may also preferably include one or more informational regions 507*a*, 507*b* that display various statistics and/or other game play information that may be of interest to the player (for example, including a time of play, a current score, a current number of cards advanced to the foundation stacks ("solved"), an indication of the number of games played ("redeals") and/or an indication of a number of wins.

Elements of the game play field illustrated by FIG. 5 may be most appropriately provided for particular variants of the solitaire game. The game play field of FIG. 5, for example, is illustrated with elements that are suitable for playing the game of Klondike solitaire. It will be appreciated by those skilled in the art that these elements may be readily adjusted to suit the type of solitaire game being played without departing generally from aspects of the present disclosure disclosed herein.

Returning to the exemplary operational overview 400 of FIG. 4, as described supra with reference to step 407, the operating software of the computer-implemented game may preferably suggest a recommended game play move to a player in advance of the move, and present this recommended move for example in an informational region 508 as depicted in FIG. 5. According to an aspect of the disclosure, the recommendation may be preferably be provided with reference to a plurality of predetermined ordinally-ranked solitaire game play rules that are sequentially evaluated for determining the recommended move. This aspect of the disclosure is further described with reference to FIGS. 7 and 8.

After the player selects and inputs each game move, the operating software of the game prepares an updated game play field for display on the display 500. The process continues until the operating software determines that the game has ended (for example, by determining that no allowable game moves are possible according predetermined optimum ordinally-ranked solitaire game play rules). At the conclusion of the game, as described supra with reference to the exemplary operational overview 400 of FIG. 4, the operation software may determine a number of cards that have been advanced to the stacks, and calculate a corresponding payout for each of these cards as a function of a corresponding per-card payout amount. This payout amount may then, for example, be electronically added to a player's play fund account or to a credit meter if the gaming device is a video slot machine device, or alternatively be signaled to a payout device that provides the player with some physical form of payout (for example, cash, tokens, vouchers or the like). One of skill in the art will recognize that this calculation may be equivalently performed, for example, either as cards are advanced to the foundation stacks or at the conclusion of the game. After a game has ended, the player may preferably be invited by the game to elect to play another game using some designated input of the game. If elected, the game returns to a step at which the player is invited to select a new payment amount. If not elected, the game may invite the player to "cash out" according to one of the payout means described above. If game play continues, information summarizing multi-game play results may for example be prepared by the computer-implemented game and displayed as described supra in information regions 507*a*, 507*b*.

Figure 6:
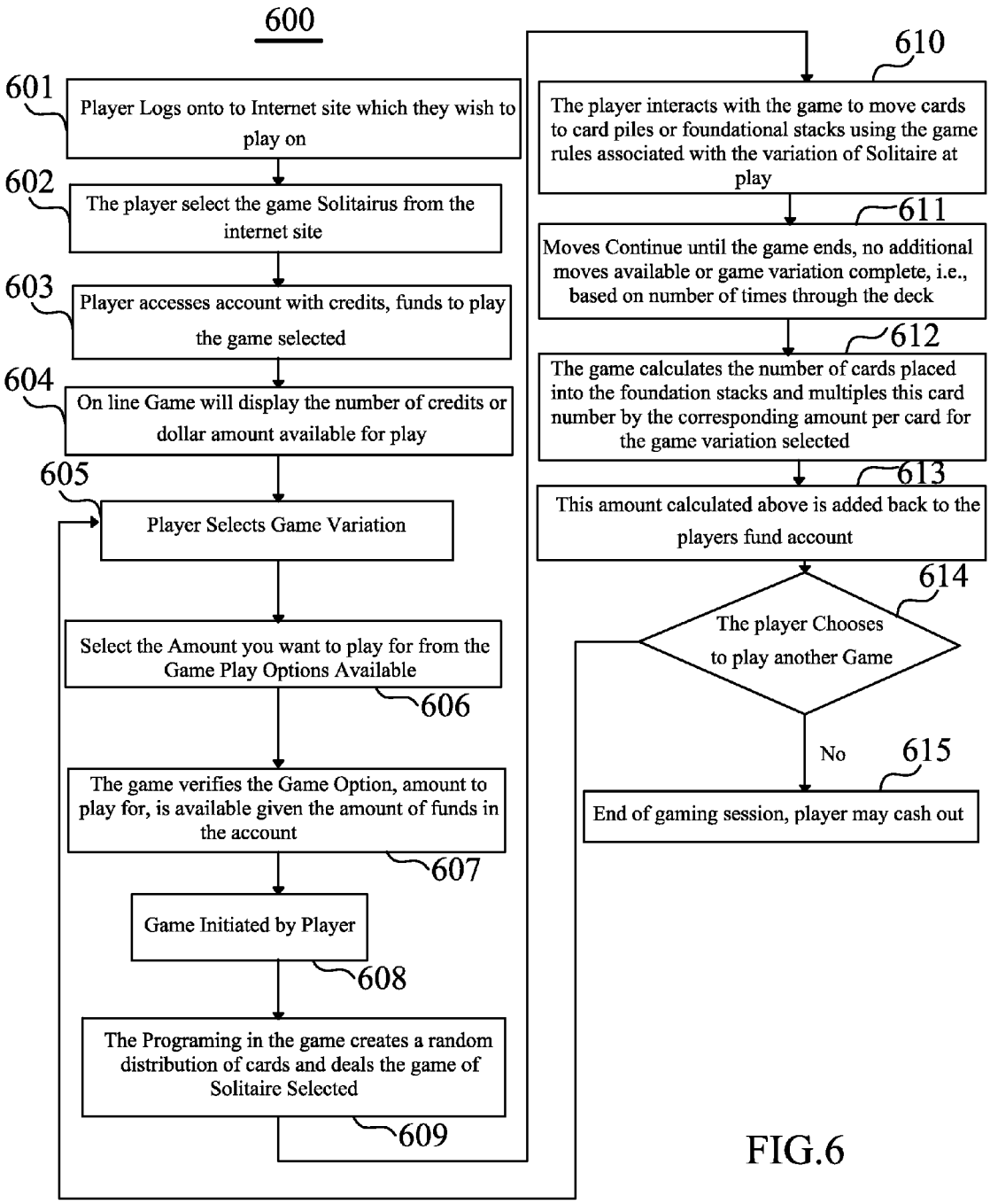
FIG. 6 is a flow diagram depicting an exemplary operational overview for playing an Internet gaming system-based solitaire game according to an aspect of the present disclosure.

FIG. 6 provides an additional flow diagram depicting an exemplary operational overview 600 for playing an Internet gaming system-based solitaire game according to an aspect of the present disclosure. The overview 600 is quite similar to overview 400 previously described with reference to FIG. 4.

At steps 601 and 602, the player initially logs in to a particular Internet site of interest and selects the electronic, computer-implemented solitaire game. Once logged in, at step 603, the game accesses a player account associated with the log-in to enable the player to select a payment amount and later to post a payment amount at the conclusion of a game. At step 604, and after log-in, the computer-implemented game will preferably reveal account information including, for example, credits or dollars available for game play.

At step 605, the player selects a particular solitaire game variation or type (for example, a three-card draw game or a one-card draw game), and at step 606 selects a play amount (for example, one game, two games, and so on). At step 607, the game then verifies the inputs provided by the player, and activates an indicator (for example, on a display screen or associated indicator lamp) instructing the player that a game is ready to be played. The player then operates an input device (for example, a game play button) at step 608 to initiate that game.

At step 609, the computer-based solitaire game proceeds to prepare an electronic representation of a randomly-ordered card deck, and a display format for representing the game play field on a display device. Although not shown, the computer-based game may then proceed to identify a recommended move to the player (for example, by a applying a rule set including a series of ordinally-ranked game play rules).

The player is then able at step 610 to provide inputs for making desired game moves in accordance with the current state of the game as displayed in the game play field on the display screen (for example, moving a faceup card at a bottom end of one of the card piles to one of the foundation stacks). The player's desired moves are evaluated by the computer-implemented game (for example, by applying the series of ordinally-ranked game play rules). If feasible according to the ordinally-ranked game play rules, the moves are processed and an updated game play field is displayed on the display screen.

At step 611, the player moves continue to be processed by the computer-implemented game until the game determines that no additional feasible moves are available to the player and/or that a game ending event has occurred (for example, completing a predetermined number of draws through the card deck). Then, at step 612, the computer-implemented game calculates corresponding payout for each of these cards placed onto the foundation stacks as a function of a corresponding per-card payout amount, which is accumulated in the player's fund account at step 613. As described supra with reference to the exemplary operational overview 400 of FIG. 4, one of skill in the art will recognize that this accumulation may occur, for example, either as cards are advanced to the foundation stacks or at the conclusion of the game.

At step 614, the player decides whether or not to proceed to play another game, or to conclude the game play session. If the player decides to continue, the computer-implemented game returns to step 605 for the player to select a game variation or type, and continues on sequentially to step 606. Otherwise, the game play session concludes at step 615, so that the computer-implemented game may enable the player to cash out an award balance for the game play session or accumulate the award balance as funds on account. The player may for example preferably directing that any net balance in the player's account be electronically transferred to a financial institution, or alternatively elect to receive a debit card by mail in the amount of the net funds. The debit card will preferably require a PIN or some other security device in order to be activated upon receipt. One of skill in the art in casino gaming will recognize many other mechanisms effective for cashing out the player.

As compared to other games typically found on a casino floor (for example, including video poker, keno slots and video slots), video solitaire is a game that requires many player game moves and requires a significantly longer time to play. For example, while a game operator may reasonably expect that a video slot machine will be played at a game play rate of 10 to 12 spins per minute (each spin effectively representing a "play"), that operator may reasonably expect that a single game of solitaire may on average take 1 minute or more to play. As a result, the possible outcomes of solitaire games are more varied, and therefore have been more difficult to model and/or to predict. Absent an ability to prove a suitability of game outcomes according to regulatory requirements (for example, including acceptable casino hold percentages to be accumulated during play), video solitaire has not been widely introduced heretofore on the casino floor and in other gaming environments. As an aspect of the present disclosure, a method of simulating solitaire game play is disclosed that enables game outcomes to be reliably predicted, and thereby enables regulatory requirements for introducing the game to be satisfied.

Figure 7:
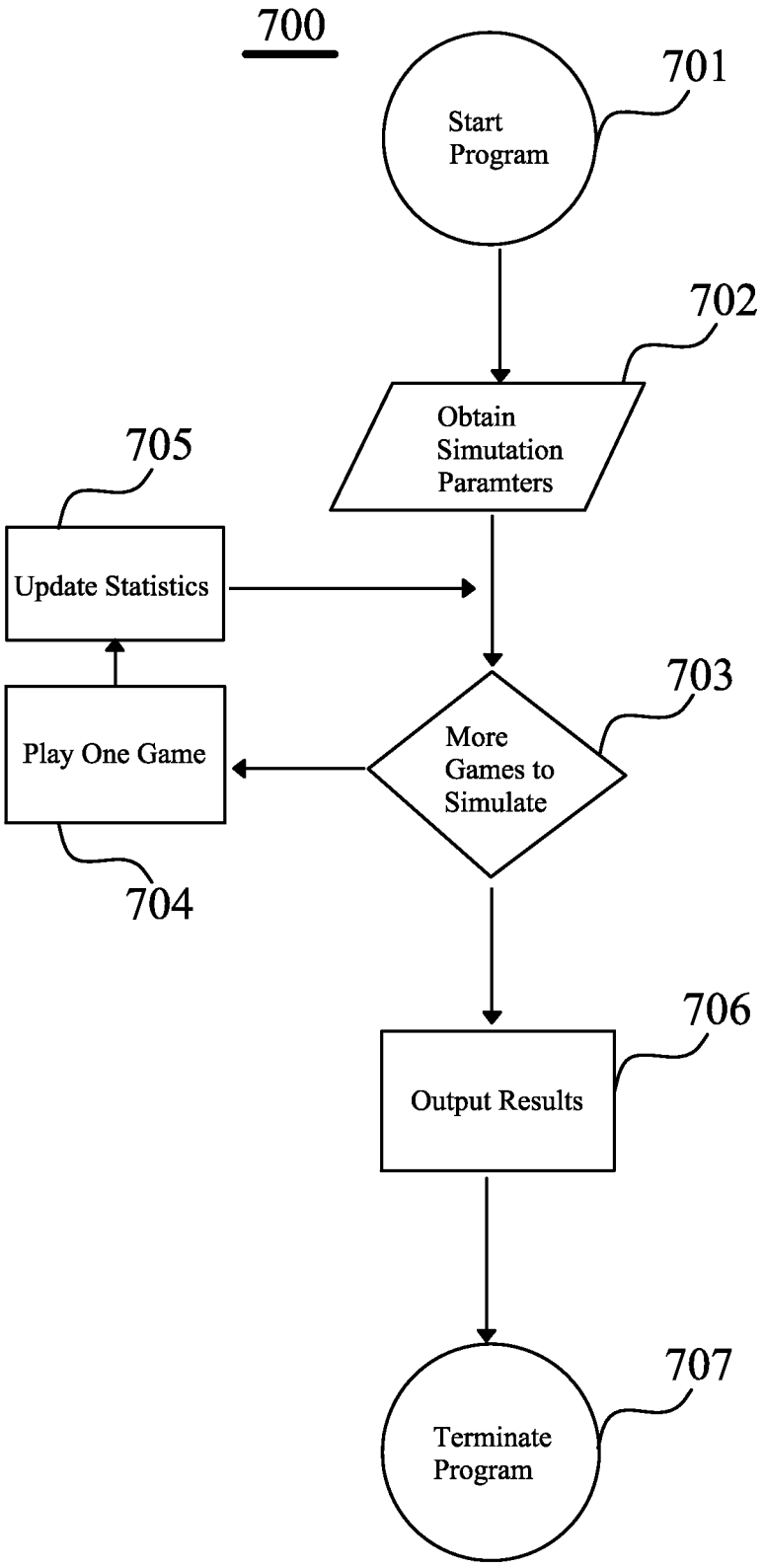
FIG. 7 is a flow diagram depicting an exemplary operational overview for simulating the play of a computer-based solitaire game according to an aspect of the present disclosure.

FIG. 7 is a flow diagram depicting an exemplary operational overview 700 for a computer-implemented process for simulating the play of a computer-based solitaire game according to an aspect of the present disclosure. The computer-implemented process as described may, for example, may be executed using a conventional simulation software platform executed on a computer, for example, as described previously with reference to FIG. 3.

As illustrated in FIG. 7, the process begins at step 701 with an initialization step. At step 702, a series of simulation parameters are obtained to direct processing (for example, defining a number of games to be simulated, a particular rule base to be applied to the simulation, and the like). Based on these parameters, the process proceeds at step 703 to determine whether additional games need to be simulated according to the simulation parameters (in other words, have a cumulative number of simulated games reached or exceeded the defined number of games to be simulated). If a next simulated game is to be played, the process initiates a game play at step 704, captures related game play statistics at step 705 (for example, including the resulting number of cards advanced to stacks), and returns to step 703 to determine whether additional games need to be simulated. If no additional games need to be simulated, the process proceeds to output the cumulative statistical results at step 707 and then terminate at step 707.

Figure 8:
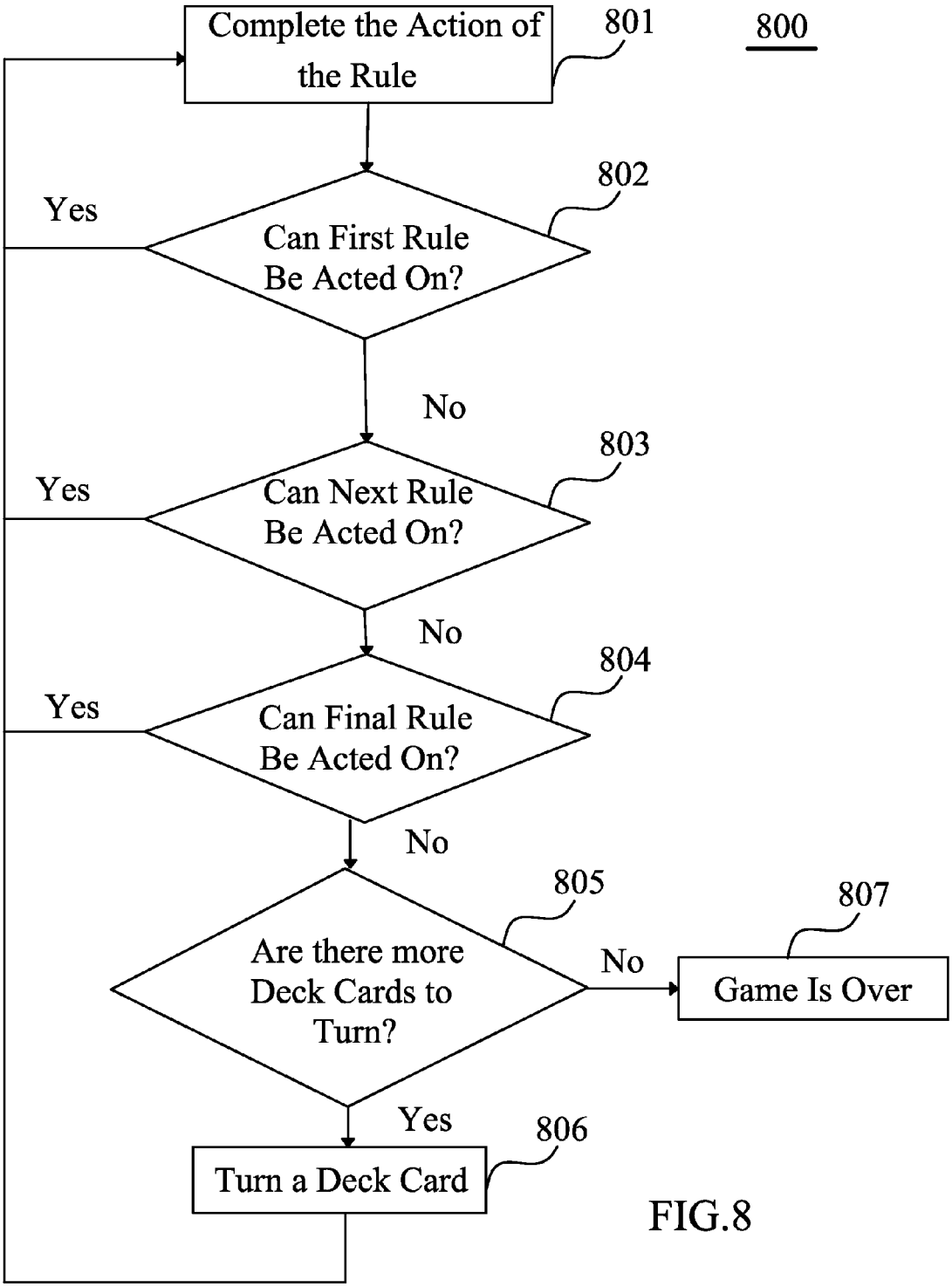
FIG. 8 is a flow diagram depicting an exemplary operational overview for executing a rule base used in simulating the play of a computer-based solitaire game according to an aspect of the present disclosure.

According to an aspect of the present disclosure, the solitaire games are effectively simulated by carrying out an exemplary computer-implemented process in which game play rules are selected and applied in an optimal order (that is, from most advantageous to least advantageous). FIG. 8 is a flow diagram depicting an operational overview 800 for carrying out the exemplary computer-implemented process according to an aspect of the present disclosure.

As depicted in FIG. 8, the process begins at step 801 with completion of an action associated with a selected rule. At step 802, the computer-implemented process evaluates the first (and most advantageous) game play rule among the ordinally-ranked game play rules to determine whether this rule can be applied to select a feasible game play move based on a current status of the game (for example, as characterized by current configurations of the card piles, the card deck and the foundation stacks in the game play field). If the first rule cannot be acted on, the process proceeds at step 803 to evaluate to the next most advantageous game play rule (and successive next most advantageous game play rules, as necessary). If a rule can be acted on, the process proceeds at step 801 to complete the action of the rule, and then begins once again to examine the applicability of the rules in the optimal sequence to determine whether another move can be made. At step 804, if none of the rules can be acted on (for example, as indicated by successively evaluating the rules and determining that none of the rules, including the final rule of the sequence, can be acted on), the process proceeds a step 805 to determine whether there are any more cards in the card deck that can be advanced to be considered for a game play. If additional cards are available, the next available card is advanced at step 806 and the process returns to step 802 to examine the applicability of the rules in optimal sequence to determine whether another move can be made. When no cards remain that have not been considered according to the current array of cards, the game is ended at step 807.

One of skill in the art will readily recognize that the individual optimal game play move rules and their ordering may vary as a function of general game play rules for each individual variation of a solitaire game. As an example, one set of ordered game play move rules for a solitaire game could consist of the following move rules in the indicated order:

1) Ace on the exposed deck to stack;
2) Ace on top of a card pile to stack;
3) deal from hidden deck if exposed deck is currently empty;
4) expose a card pile down card;
5) card pile King to empty card pile;
6) move a card chain to another card chain allowing a hidden card pile to be exposed;
7) exposed deck King to empty card pile;
8) non-Ace or King card on the exposed deck to a card chain on a card pile;
9) non-Ace card pile card to the stack;
10) Split a card chain by moving a portion to another pile in order to expose a card that can be moved to a stack;
11) non-Ace single card pile card to stack;
12) non-Ace card on exposed deck to stack;
13) card pile card to stack, which allows an exposed deck card to be moved to the stack;
14) move card off stack to a card pile, which allows a card on top of the exposed deck to be moved to a card pile or stack;
15) move card off stack to a card pile, which allows a card chain to move to expose a hidden card in the pile;
16) deal from hidden deck if exposed card is not empty;
17) reset deck (place all exposed deck cards back in hidden deck)[1]; and

[1] This rule is preferably used in a solitaire game in which each successive third card is drawn from the deck.

18) move card chain with no hidden cards to another pile.

Alternatively, one of skill in the art will recognize many variants of these rule and orderings for use in alternate types of solitaire games, or for producing sub-optimal game play results (for example, if a player population is anticipated that includes a significant number of novice or casual players).

FIG. 9 is a table depicting an exemplary outcome for a simulated game play according to the processes of FIGS. 7, 8. In order to reach a statistically stable result, the number of simulated games may preferably be exceed one million simulated games. Statistics may for example be collected on a per game basis that identify the number of cards reaching the foundation stacks (91), and a percentage of games resulting in each possible number of cards reaching the stack (92), a player cost to play 94. For the selected game play cost 94 and a per card player award amount 93, a house advantage 95 for each possible number of cards reaching the foundation stacks can be calculated as the difference between the game play cost 94 and the product of the applicable number of foundation stack cards 91 and the per card player award amount 93 (payout 97, "$ Win") divided by the selected game play cost (94). Although the example of FIG. 9 illustrates a per card player award amount that is fixed at $4.75, the present disclosure also contemplates variable per card player award amounts (94) that may, for example, vary according to the number of foundation stack cards 91, the identities of the foundation stack cards and/or a distribution of the transferred cards among the foundation stacks.

A weighted house advantage 96 for each possible number of cards reaching the foundation stacks can be calculated as the product of the applicable percentage 92 and payout 97. The sum of weighted house advantages 96 for all possible numbers of cards reaching the foundation stacks provides an expected payout value for the selected game play cost 94 and a per card player award amount 93. The sum of the product of applicable percentages 92 and number of foundation stack cards 91 for all possible numbers of cards reaching the foundation stacks provides an expected value for the numbers of cards reaching the foundation stacks.

Figure 10:
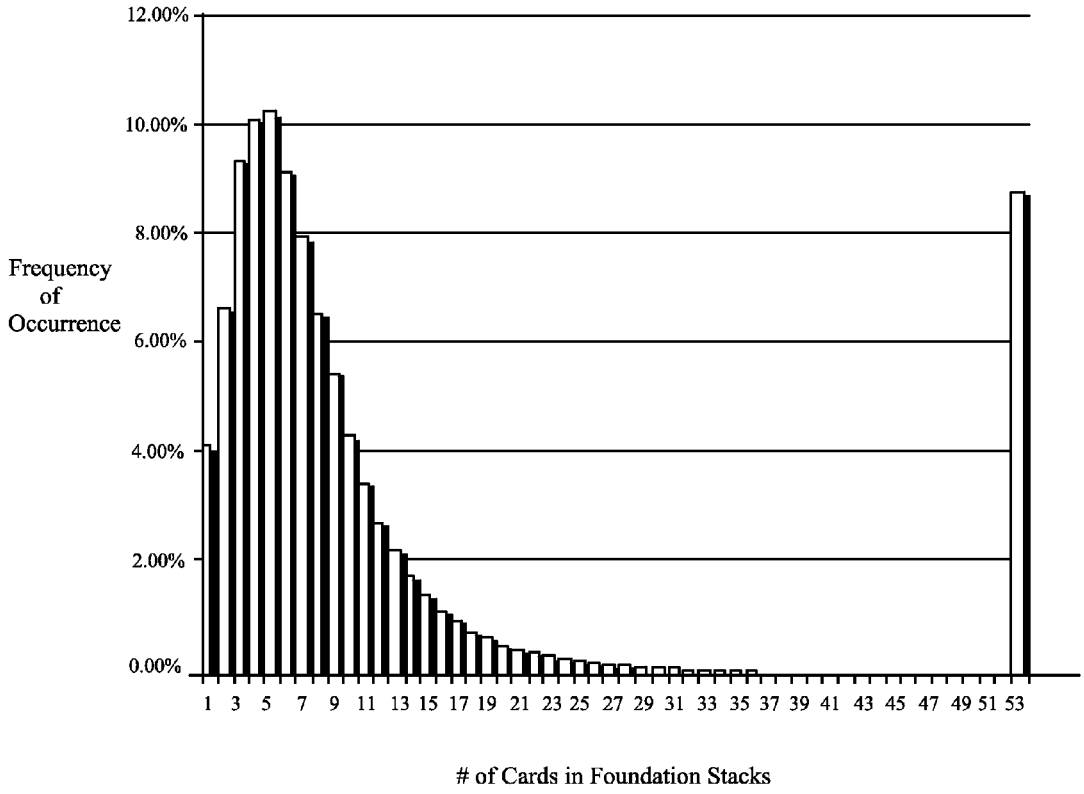
FIG. 10 is a bar diagram depicting a frequency of occurrence for possible numbers of cards transferred to foundation stacks during a simulated game play according to an aspect of the present disclosure, in which successive third cards in a card deck are selected moving three times through the deck.
Figure 11:
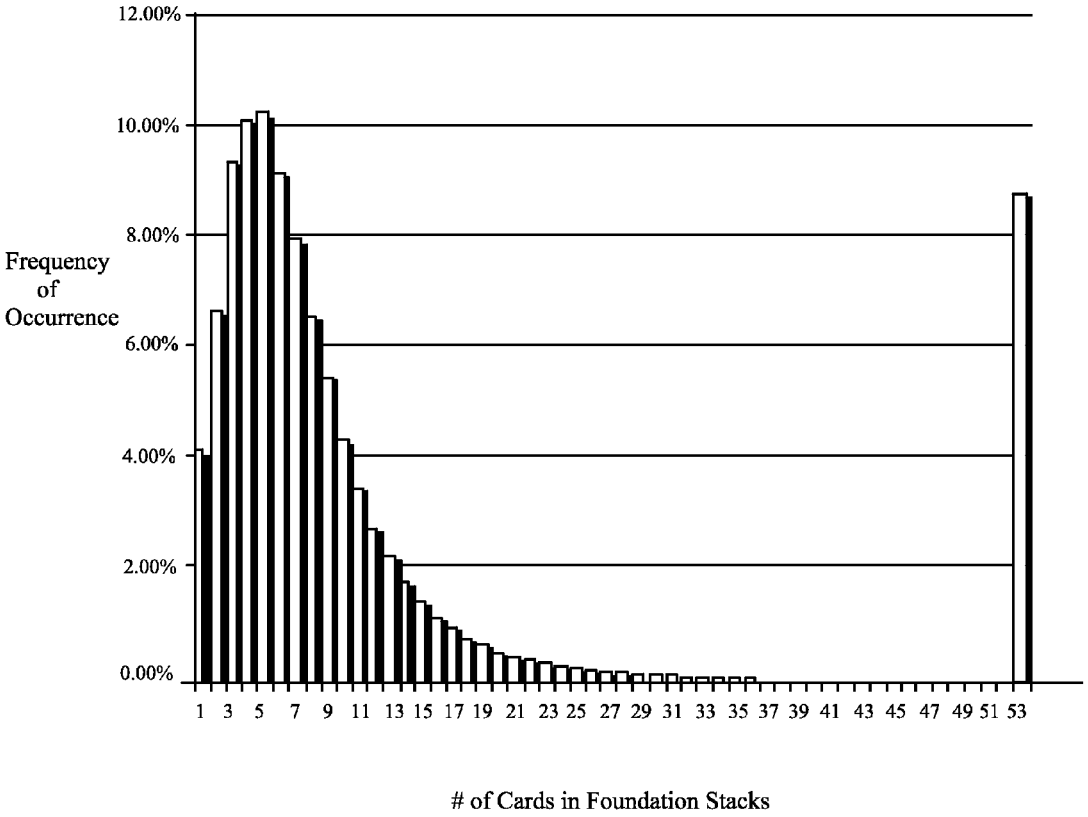
FIG. 11 is a bar diagram depicting a frequency of occurrence for possible numbers of cards transferred to foundation stacks during a simulated game play according to an aspect of the present disclosure, in which each card in a card deck is selected moving one time through the deck.

FIG. 10 presents a bar diagram depicting a frequency of occurrence (in other words, percentages 92) for possible numbers of cards transferred to foundation stacks based, for example, on the simulated game play statistics of FIG. 9. In this case, the simulation was carried out for a solitaire game in which successive third cards in the card deck are selected, moving three times through the deck. FIG. 11 presents similar results for a solitaire game simulation in which each card in a card deck is selected moving one time through the deck. Comparatively, and perhaps surprisingly, the distributions of numbers of cards advanced to stacks in each figure are quite similar. In each case, the simulation results show that fifteen or fewer cards will be advanced to the stacks in approximately eighty-five percent of all games.

FIG. 12 presents a first table illustrating payout information based on simulated game play results according to an aspect of the present disclosure. Tables of this type for other traditional casino games are often referred to as "PAR sheets." Fig. illustrates payout information for simulated game results based on games played by applying a "one-time, one card" selection from the card deck. A "hold advantage" (HA/PAR) 1203 is calculated for a variety of selected cost to play/payout per card pairings 1201, 1201. For an example 1204, the payout information shown includes a cost to play 1301 of $35.00, a payout per card 1302 of $3.25, and a HA/PAR 1303 of 93.61. Interpreted, this indicates that a game operator applying this pairing over time would expect to pay out 94.61% of the monies paid by all players to play, thereby retaining retain 6.39% of these monies as the expected hold percentage. FIG. 12 further illustrates the impact of adding additional bonus payout features to this game. For an example 1205, if an additional 3% bonus payout 1206 is granted under certain "bonus" conditions (for example, in the event that the player wins the game by playing all cards on the stacks or uncovers a particular wild card hidden in one of the card piles during game play), HA/PAR is 96.61 (reducing the expected hold percentage to 3.39%).

FIG. 13 is presents a second table illustrating similar payout information based on simulated games played by applying a "three-time, third card" selection from the card deck. In this case, for an example 1304, the payout information shown includes a cost to play 1301 of $35.00, a payout per card 1302 of $3.25, and a HA/PAR 1303 of 95.61. Interpreted, this indicates that a game operator applying this pairing over time would expect to pay out 95.61% of the monies paid by all players to play, thereby retaining retain 4.39% of these monies as the expected hold percentage. As an alternative to example 1304 that includes an additional bonus feature as described supra, an example 1305 shows payout information including a cost to play 1301 of $35.00, a payout per card 1302 of $3.25, a bonus percentage 1306 of 3% and a total payout percentage 1307 HA/PAR of 95.61 (and expected hold percentage of 4.39%). As compared to the example 1304, the game operator's expected hold percentage is held constant with the introduction of an additional bonus opportunity and reduction in the payout per card for cards transferred to the foundation stacks. As implied by the examples 1304, 1305, the game simulations can be advantageously used by game operators to identify a variety of game variants (in this case, with and without bonus features) that can be offered without affecting a long-term hold percentage target that has been approved by regulators for the game.

Heretofore unavailable for games having a play complexity like that of solitaire, these tables as derived from the simulated game play statistics provide substantial insights about game play to game operators and credible reassurance to regulators that the games as administered by the game operators will not violate regulations concerning the hold advantage maintained by the operators.

At this point, while we have presented this disclosure using some specific examples, those skilled in the art will recognize that our teachings are not so limited. Accordingly, this disclosure should be only limited by the scope of the claims attached hereto.

We claim:

1. A method of operating a computer-based solitaire game playable by a player for a player's fee, the method comprising the steps of:

generating an electronic representation of a randomly-ordered card deck for playing a game;

generating an electronic representation of a play field based upon the randomly-ordered card deck;

receiving player inputs at a user interface for advancing the game;

accepting the player inputs according to a predetermined set of game play rules, updating the play field according to the player inputs, the predetermined game play rules and the card deck; and upon detecting an end of game indication according to the predetermined game play rules, performing the additional steps of:

determining an actual number of cards transferred to foundation stacks as of the end of game indication;

and providing a payout to the player that is calculated as a function of a per-card payout award and the actual number of cards transferred during the game, wherein the per-card payout award is determined as a function of an expected number of transferred cards and the player's fee, wherein the expected number of transferred cards is determined as a function of a discrete probability density function including probability values for each possible number of cards transferred, the discrete probability density function being calculated from game outcomes produced in a multi-game computer-based simulation, and wherein the number of games simulated in the multi-game simulation is selected to provide a statistically stable result.

2. The method of claim 1, wherein the expected number of transferred cards is approximately 10.

3. The method of claim 1, wherein the number of games simulated in the multi-game simulation exceeds one million games.

4. The method of claim 1, further comprising the step of:

displaying the an electronic representation of a play field on a display device.

5. The method of claim 1, further comprising the step of:

determining an expected percentage of players' fees that is held on average by a game operator as a function of the discrete probability density function, the players' fees and the per-card payout award.

6. The method of claim 1, wherein the per-card payout award is variable as a function of the number of cards transferred during the game.

7. The method of claim 1, wherein the per-card payout award is variable according to identities of the transferred cards.

8. The method of claim 1, wherein the per-card payout award is variable according to a distribution of the transferred cards among the foundation stacks.

9. The method of claim 1, further comprising the step of:

providing game play recommendations to the player according to the game play rules, wherein the game play rules comprise a set of predetermined ordinally-ranked solitaire optimal game play rules and each recommendation satisfies a game play rule having a highest ordinal ranking among the ordinally-ranked solitaire optimal game play rules.

10. The method of claim 9, wherein the predetermined ordinally-ranked solitaire game play rules reflect an optimal game play strategy.

11. The method of claim 9, wherein the predetermined ordinally-ranked solitaire game play rules reflect a non-optimal game play strategy.

12. The method of claim 5, wherein the expected percentage is between 2% and 11% of the players' fees.

13. A computer-based method for determining an expected number of cards that will be transferred to foundation stacks in a computer-based solitaire game, the method performed on a computer utilizing a processor and comprising the steps of:

a) generating an electronic representation of a randomly-ordered card deck for a solitaire game;

b) simulating game play by executing available card plays according to applicable game play rules selected from a plurality of predetermined ordinally-ranked solitaire game play rules, each selected rule having a highest ordinal ranking among applicable solitaire game play rules;

c) updating the electronic representation of the play field according to the card plays, the predetermined game play rules and the card deck;

d) determining a number of cards transferred to the foundation stacks in the play field upon detecting an end of game indication;

e) storing information indicative of the number of cards transferred in a memory;

f) repeating steps a)-e) while a standard deviation for a discrete probability density function for number of cards transferred, calculated based on the stored numbers, is less than a predetermined value; and g) calculating an expected value for the number of cards transferred per simulated game according to the stored information.

14. The method of claim 13, wherein the expected value for the number of transferred cards is approximately 10.

15. The method of claim 13, wherein:

the probability values in the discrete probability density function for the numbers of cards transferred are non-uniform.

16. The method of claim 13, further comprising the steps of:

h) selecting values for a player's fee and a per-card payout award;

i) calculating an expected payout for each possible number of transferred cards as a function of the number of transferred cards, an associated probability value of the discrete probability density function and the per-card payout award; and j) calculating a game operator's house advantage as a function of the sum of the expected payouts for each possible number of transferred cards and the player's fee.

17. The method of claim 16, further comprising the step of:

l) recalculating the game operator's house advantage as a function in addition of a bonus payout.

18. The method of claim 16, wherein the per-card payout award is variable as a function of the number of transferred cards.

19. The method of claim 16, wherein the per-card payout award is variable according to identities of the transferred cards.

20. The method of claim 16, wherein the per-card payout award is variable according to a distribution of the transferred cards among the foundation stacks.

21. The method of claim 13, wherein the predetermined ordinally-ranked solitaire game play rules reflect an optimal game play strategy.

22. The method of claim 13, wherein the predetermined ordinally-ranked solitaire game play rules reflect a non-optimal game play strategy.

23. The method of claim 1, wherein the game outcomes produced in the multi-game simulation are produced in game simulations executing available card plays according to applicable game play rules selected from a plurality of predetermined ordinally-ranked solitaire game play rules, each selected rule having a highest ordinal ranking among applicable solitaire game play rules.

* * * * *